US005699717A

United States Patent [19]

Riedlinger

[11] Patent Number: 5,699,717

[45] Date of Patent: Dec. 23, 1997

[54] DIAPHRAGM PUMP WITH SHAPED DIAPHRAGM HAVING RADIALLY AND CIRCUMFERENTIALLY EXTENDING RIBS

[75] Inventor: Heinz Riedlinger, Freiburg, Germany

[73] Assignee: KNF Neuberger GmbH, Freiburg, Germany

[21] Appl. No.: 618,959

[22] Filed: Mar. 20, 1996

[30] Foreign Application Priority Data

Mar. 24, 1995 [DE] Germany ..... 195 10 828.0

[51] Int. Cl.[6] ..... F01B 19/00

[52] U.S. Cl. ..... 92/98 R; 92/96; 92/103 R

[58] Field of Search ..... 92/96, 97, 98 R, 92/99, 100, 103 F, 103 R

[56] References Cited

U.S. PATENT DOCUMENTS

| | | | |
|---|---|---|---|
| 2,840,339 | 6/1958 | Price | 92/98 R |
| 3,135,173 | 6/1964 | Jack, Jr | 92/99 |
| 3,204,568 | 9/1965 | Grossfield | 92/98 R |
| 3,872,777 | 3/1975 | Mastis | 92/99 |
| 3,911,796 | 10/1975 | Hull et al. | 92/99 |
| 4,270,441 | 6/1981 | Tuck, Jr. | 92/98 R |
| 5,335,584 | 8/1994 | Baird | 92/98 R |

FOREIGN PATENT DOCUMENTS

| | | |
|---|---|---|
| 0 010 943 A1 | 5/1980 | European Pat. Off. . |
| 2 482 674 | 11/1981 | France . |
| 40 07 932 A1 | 9/1991 | Germany . |

*Primary Examiner*—Thomas E. Denion

*Attorney, Agent, or Firm*—Panitch Schwarze Jacobs & Nadel, P.C.

[57] ABSTRACT

A diaphragm pump (1) has a shaped diaphragm (2) of elastic material. The central zone (3) of the diaphragm (2) is thickened in the direction of stroke and is surrounded by a flexible annular zone (5) held on the pump case by an external clamping edge (6). The central zone (3) of the diaphragm (2) is engaged by a connecting rod (11) with which the shaped diaphragm (2) is displaceable from a top to a bottom dead-centre position and vice versa. Radial ribs (19) as well as stabilizing ribs (19) extending in the circumferential direction are arranged on the underside (17) of the annular zone (5). Therefore a shaped diaphragm (2) is obtained which in the annular zone (5) is flexible about a circumferential line, but which nevertheless exhibits comparatively high flexural strength about a diametral line. Deformation of the shaped diaphragm (2) under vacuum is thereby reduced.

14 Claims, 5 Drawing Sheets

DIAPHRAGM PUMP WITH SHAPED DIAPHRAGM HAVING RADIALLY AND CIRCUMFERENTIALLY EXTENDING RIBS

FIELD OF THE INVENTION

The invention relates to a diaphragm pump with a shaped diaphragm of elastic material, the central zone of the diaphragm being thickened in the direction of stroke and being surrounded by a flexible annular zone held on the pump case by an external clamping edge, which shaped diaphragm is displaceable from a top to a bottom dead-centre position and vice versa by means of a connecting rod or similar reciprocating means acting upon the central zone of said diaphragm, wherein particularly the central zone of the upper surface of the diaphragm facing the pumping chamber and the adjacent wall of the pumping chamber are geometrically adapted to each other, and at least the annular zone of the underside of the diaphragm facing away from the pumping chamber is provided with radial ribs for stabilization.

BACKGROUND OF THE INVENTION

A diaphragm pump of such a character is already known from DE 40 07 932 C2, wherein the central zone of the pumping chamber wall facing the shaped diaphragm is of substantially spherical form and the associated central zone of the upper surface of the shaped diaphragm is geometrically adapted to this spherical area of the pumping chamber. Therefore, in the top dead-centre position, at least the central zone of the upper surface of the shaped diaphragm engages over almost its whole area with the wall of the pumping chamber. To enable that the flexing work occurring in the shaped diaphragm during pumping be minimized and that the diaphragm pump nevertheless has a sufficient intake volume in the discharge stroke, the annular zone of the shaped diaphragm is devised to be comparatively thin and flexible, whereas the central zone is thickened in the direction of stroke in order to attain a kind of piston action during the movement of stroke.

In order that in use of these diaphragm pumps, preferably employed as vacuum pumps, the danger is reduced of the shaped diaphragm bulging in the direction of the adjacent pumping chamber wall during operation of the pump—particularly in the suction stroke—the known diaphragm pump has radial ribs on the underside of the annular zone which are intended for its stabilization.

Such shaped diaphragms provided with radial ribs have proved successful in many respects in practice. However it has become apparent that, particularly in the case of vacuum pumps used as forepumps for turbomolecular pumps, unwanted bulging of the diaphragm can be prevented to a sufficient degree only if and when a plurality of radial ribs are arranged closely adjacent to one another on the underside of the annular zone. This has the drawback though that the flexibility of the annular zone is reduced accordingly, increasing the flexing work, the heating of the diaphragm and the attendant wear of the diaphragm.

If, on the other hand, the radial ribs are arranged so far apart from one another that the diaphragm has sufficient flexibility in the annular zone, the annular zone bulges excessively, so that at low suction pressures the volumetric efficiency and the exhaustion rate of the pump is reduced accordingly. In addition oscillations in the diaphragm may occur. On the one hand these are liable to lead to heating of the shaped diaphragm and on the other hand they are also liable to cause the shaped diaphragm to impinge on the adjacent wall of the pumping chamber. Such impingement is undesired particularly because in addition to increasing the generation of noise, it also leads to premature wear of the shaped diaphragm. At the same time particles abraded from the shaped diaphragm may also detract from the operation of the inlet and outlet valves, additionally reducing the quality of the vacuum to be achieved with the diaphragm pump.

SUMMARY OF THE INVENTION

Therefore the object underlying the invention is to provide a diaphragm pump of the kind set forth at the outset, wherein the annular zone of the shaped diaphragm is sufficiently flexible to enable the movement of stroke to be as smooth as possible with only small flexing work losses. Nevertheless the deformations of the annular zone of the diaphragm under vacuum are minimized, so that the exhaustion rate of the diaphragm pump is improved accordingly.

In a diaphragm pump of the kind set forth at the outset, this object is accomplished in that at least one stabilizing rib running substantially in the circumferential direction is arranged at the underside of the annular zone between adjacent radial ribs.

The expression "running substantially in the circumferential direction" is intended to signify that the stabilizing ribs are oriented either in the circumferential direction, hence concentrically with respect to the longitudinal axis of the diaphragm, or that they are oriented tangentially to the circumferential direction or somewhat obliquely to the circumferential direction, for instance spirally. Thus in the diaphragm pump embodying the invention, the annular zone of the shaped diaphragm is supported by the radial ribs as well as by the stabilizing ribs running transversely thereto. The radial ribs can therefore be arranged sufficiently far apart from one another to produce an especially flexible annular zone that involves only comparatively slight flexing work during pump operation. Nevertheless bulging of the annular zone and the accompanying oscillations, particularly in the suction movement of the diaphragm and at high underpressures, are effectively avoided.

The stabilizing ribs are hence deliberately arranged in such a way that the annular zone of the shaped diaphragm is flexible about a circumferential line, but has a comparatively high flexural strength in a direction extending transversely thereto. Hence a smoothly operable shaped diaphragm is produced which converts only a very small share of the applied stroke energy to flexing work. Nevertheless oscillations in the diaphragm and its impingement on the adjacent wall of the pumping chamber in the upper dead centre are avoided. On the one hand the shaped diaphragm thereby has a longer service life and on the other hand the operation of the valves of the diaphragm pump is not impaired so quickly by the particles abraded from the shaped diaphragm. It is also advantageous that through the slight bulging of the annular zone during the suction or stroke movement, volumetric efficiency and the exhaustion rate of the diaphragm pump is improved, particularly at low pressures. The diaphragm pump embodying the invention is therefore especially suited for use as a vacuum pump. The stabilizing ribs permit a distinct reduction in deformation of the diaphragm, especially in the region of the inlet and outlet opening of the pumping chamber.

An advantageous embodiment proposes that a plurality of radially staggered stabilizing ribs are arranged between adjacent radial ribs. The forces affecting the annular zone under vacuum can then received even more uniformly by the stabilizing ribs and passed to the pump case and to the central zone of the shaped diaphragm by way of the radial ribs.

A further development of the invention proposes that the bending moment of the radial ribs about a circumferential line of the shaped diaphragm is in each case greater than that of an individual stabilizing rib about a radius crossing it of the shaped diaphragm. The radial ribs are hence made more flexurally stiff than the stabilizing ribs. In each case several stabilizing ribs co-operate with a common radial rib and are supported against the latter, permitting the number of radial ribs to be reduced. Hence an annular zone is obtained which is flexible about a circumferential line but is nevertheless comparatively resistant to bending about a diametral line and despite slight flexing work losses permits a good exhaustion rate even at working pressures in the chamber of only a few millibars.

The greater bending moment of the radial ribs in comparison to the stabilizing ribs can be achieved especially simply by the radial ribs being of a height oriented in the direction of the longitudinal axis of the diaphragm that is greater than the height of at least one stabilizing rib, particularly of the stabilizing rib arranged radially externally.

It is advantageous if the stabilizing ribs are circumferentially complete on the underside of the diaphragm and cross and penetrate the radial ribs. This enables the diaphragm forces to be transferred especially well from the stabilizing ribs to the radial ribs and from there to be conducted on the one hand radially inwardly into the central zone of the shaped diaphragm and on the other hand also radially outwardly into the pump case.

At least the radially inner stabilizing rib of the annular zone is suitably of greater height in the axial direction of the shaped diaphragm than at least one stabilizing rib arranged further outwardly. By this means a steady transition is obtained from the comparatively thin annular zone to the central zone where the shaped diaphragm is thickened in the direction of stroke. Therefore the tensile stresses and compressive stresses in the shaped diaphragm are distributed as uniformly as possible. Extension of the elastic material of the diaphragm can also be reduced by this means, this being advantageous particularly for shaped diaphragms which are Teflon-coated, since Teflon is readily susceptible to cracking due to its slight elasticity.

One embodiment proposes that the underside of the radially inner stabilizing rib adjoins the underside of the radial ribs so as to be substantially flush therewith. The rubber material used for the shaped diaphragm can then flow better during the vulcanization process into the corner areas between the stabilizing ribs and radial ribs.

It is suitable if the inner stabilizing rib has a thickness oriented in the axial direction of the shaped diaphragm, which thickness is substantially equal to or somewhat less than the thickness the central zone has at its outer edge area adjacent to that stabilizing rib. By this means an especially steady transition is obtained between the central zone and annular zone, reducing the stresses occurring in the shaped diaphragm during pump operation.

An advantageous embodiment proposes that the central zone has on the underside of the diaphragm a shoulder forming a preferably stepped transitional area to the annular zone. Therefore there is a sufficient area available in the central zone for the tensile forces, as occur in the shaped diaphragm particularly of vacuum pumps, to be transferred from the annular zone to the central zone of the shaped diaphragm. This is so despite the reduced diameter of the diaphragm in that area, so that the tensile stresses occurring there are reduced.

A transition between central zone and annular zone is especially steady and advantageous for the flux of force if the underside of the radial ribs adjoins the underside of the shoulder so as to be flush therewith and if the height of the radial ribs decreases radially outwardly at least between the shoulder and the radially inner stabilizing rib.

To enable a further enhanced and homogeous flux of force in the annular zone of the diaphragm, it is proposed that the preferably equidistantly radially staggered stabilizing ribs form a substantially undulatory profile in the radial direction, with rounded transitions between the individual stabilizing ribs. By comparison, a rectangular cross section—as considered in the circumferential direction of the shaped diaphragm—is preferred for the stabilizing ribs and/or the stabilizing projections, so as to achieve greater flexural strength.

An especially advantageous embodiment proposes that the underside of the central zone is downwardly contracted and is preferably of approximately frusto-conical shape there, that the underside of the central zone has stabilizing projections arranged substantially radially-axially and that those stabilizing projections continue outwardly in the stabilizing ribs of the annular zone. The supporting forces transferred from the stabilizing ribs to the radial ribs can then be conducted better into the central zone, so as to counteract even more effectively any deflection or bulging of the annular zone in the direction of the pumping chamber when the shaped diaphragm is subjected to vacuum.

It has proved in practice to be especially advantageous for the exhaustion rate of the diaphragm pump if the radial ribs are evenly distributed over the circumference of the shaped diaphragm so as to be staggered at intervals of about 20° and if in each case four radially staggered stabilizing ribs are provided between adjacent radial ribs.

BRIEF DESCRIPTION OF THE DRAWINGS

An exemplary embodiment of the invention will be described in further detail below with reference to the drawings depicting on different scales and partly in schematized form in FIG. 1 a sectional, partial view of a diaphragm pump with a shaped diaphragm clamped with its outer edge area between the crankcase of the diaphragm pump and the pump head, the shaped diaphragm being operatively connected to a connecting rod shown only in part.

DETAILED DESCRIPTION OF PREFERRED EMBODIMENT

Figure 1:
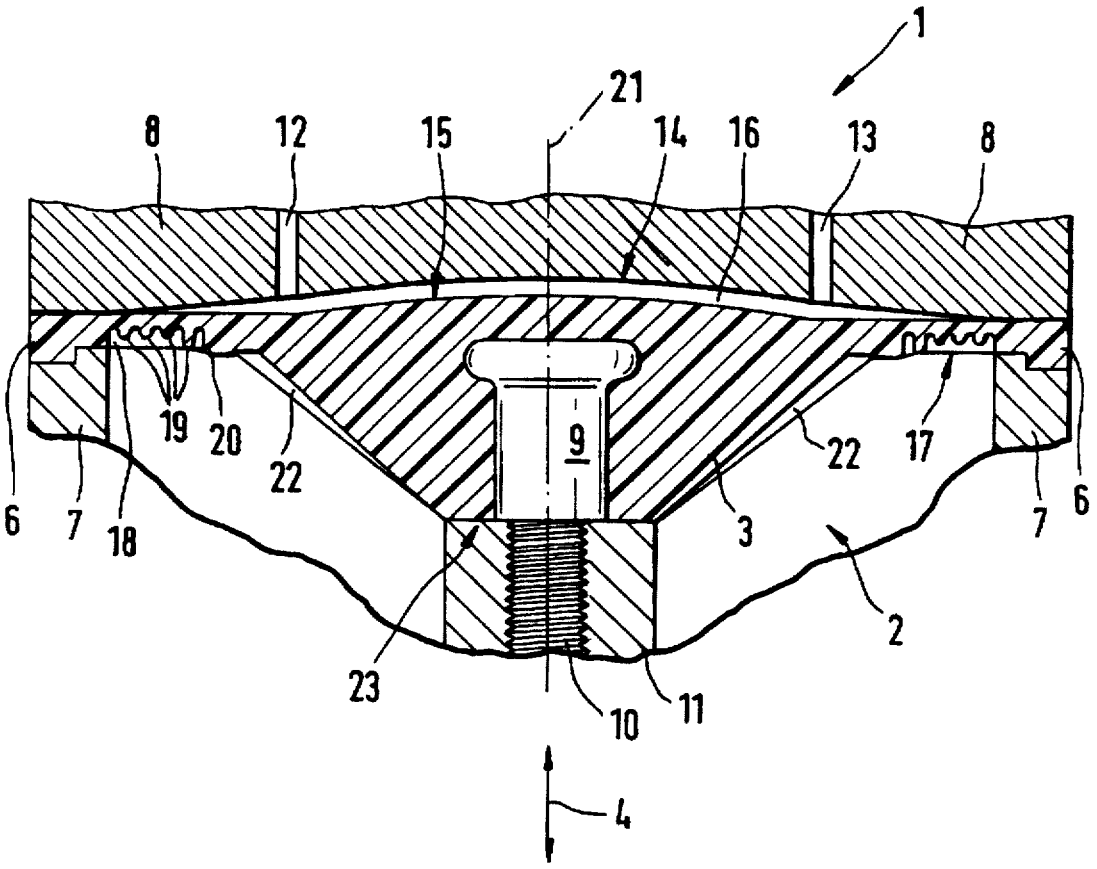
Figure 2:
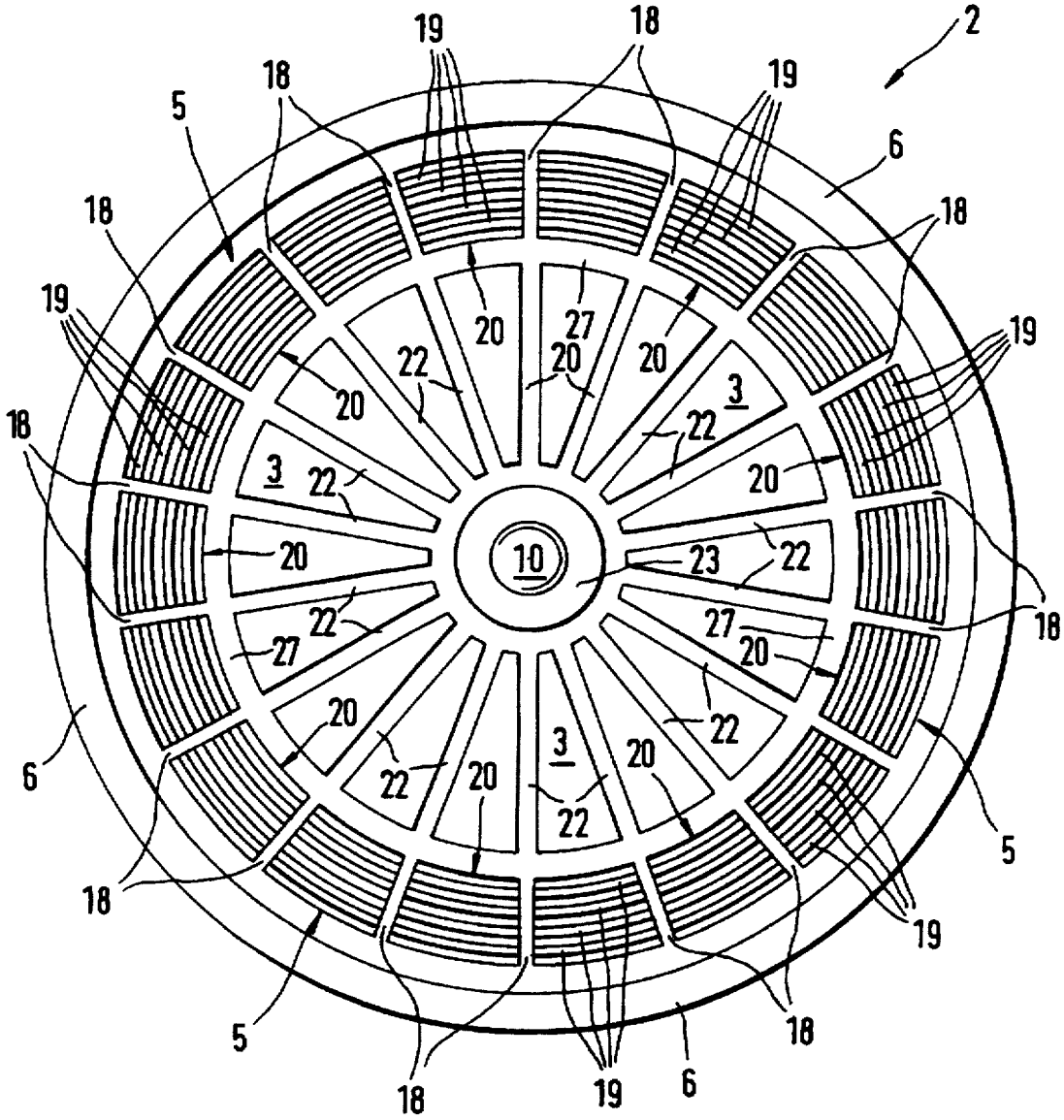
FIG. 2 is a view of the underside of the shaped diaphragm of FIG. 1, showing especially well the stabilizing ribs running in the circumferential direction, as well as the radial ribs of the annular zone that continue inwardly in the stabilizing projections of the central zone.
Figure 3:
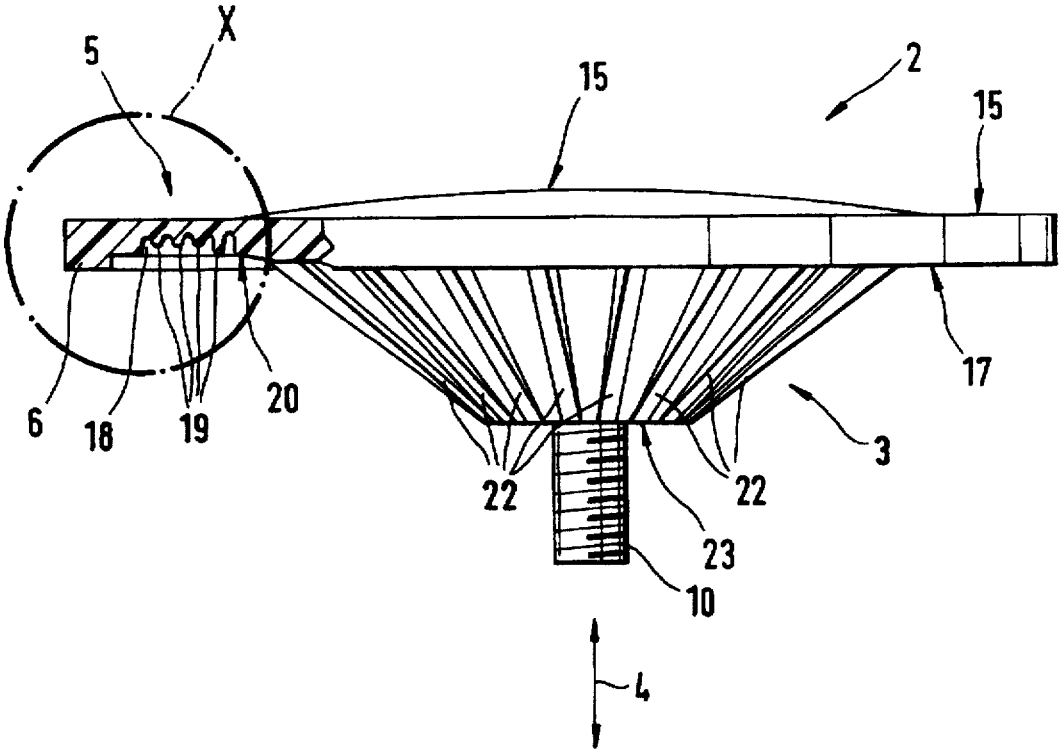
FIG. 3 is a side view of the shaped diaphragm of FIG. 1 in in an inoperative position, illustrating the annular zone partly in section in order to show the arrangement of the stabilizing ribs.

A diaphragm pump (FIG. 1), generally designated I, has a shaped diaphragm 2 of elastic material. The central zone 3 of the diaphragm 2 is thickened in the direction of stroke 4 and is surrounded by a flexible annular zone 5. The annular zone 5 has at its outer periphery a clamping edge 6 clamping it to the pump case between the crankcase 7 and the pump head 8. The shaped diaphragm 2 has a vulcanized-in shaped core 9 in the form of a driving core. The threaded stud 10 of the shaped core is acted upon by a connecting rod II with which the shaped diaphragm 2 can be displaced from a top to a bottom dead-centre position and vice versa. The pump head 8 has an inlet port 12 and an outlet port 13 for the medium to be delivered or sucked off, the ports 12, 13 ending in the pumping chamber 16 defined by the pump wall 14 of the pump head 8 and by the upper surface 15 of the diaphragm. The inlet ports and outlet ports 12, 13 are provided in a known way with inlet valves and outlet valves which for the sake of clarity are not illustrated in FIG. 1.

In order to achieve the smallest possible dead space in the top dead-centre position of the shaped diaphragm 2, the central zone 3 of the upper surface 15 of the diaphragm facing the pumping chamber 16 and the adjacent wall 14 of the pumping chamber are geometrically adapted to each other. Both the central zone of the pumping chamber wall 14 and the central zone of the shaped diaphragm 2 are of spherical form.

The shaped diaphragm 2 has in the annular zone 5 of its underside 17 facing away from the pumping chamber 16 altogether eighteen radial ribs 18 evenly distributed over the circumference of the annular zone 5. The radial ribs 18 are combined with four concentric, equispaced stabilizing ribs 19 extending circumferentially on the underside 17 of the annular zone 5. The supporting ribs 19 have intermediate recesses at which the shaped diaphragm 2 displays only a comparatively small wall thickness. Thus a shaped diaphragm 2 is obtained which exhibits especial flexibility about a circumferential line in the annular zone 5 and which in the movement of stroke converts only a very small share of the stroke energy to flexing work.

By comparison, the stabilizing ribs 19 display a comparatively high flexural strength about a diametral line, so that under vacuum the deflection or bulging of the annular zone 5 in the direction of the pumping chamber 16 is reduced. In addition, the radial ribs 18 prevent the annular zone 5 from undergoing excessive curvature about a circumferential line of the shaped diaphragm 2 when subjected to underpressure or vacuum in the pumping chamber 16.

The forces acting on the annular zone 5 during operation of the diaphragm pump 1 are hence supported by the stabilizing ribs 19 in the circumferential direction and thereby transferred to the radial ribs 18. In turn, the radial ribs 18 the one hand conduct the forces outwardly into the pump case, but on the other hand also conduct them inwardly into the central zone 3. The central zone 3 is considerably thicker than the annular zone 5 and is therefore of especial dimensional stability.

By combining radial ribs 18 with circumferentially extending supporting ribs 19, the diaphragm pump 1 displays an improved volumetric efficiency particularly at low intake pressures, resulting in a greater exhaustion rate.

Figure 5:
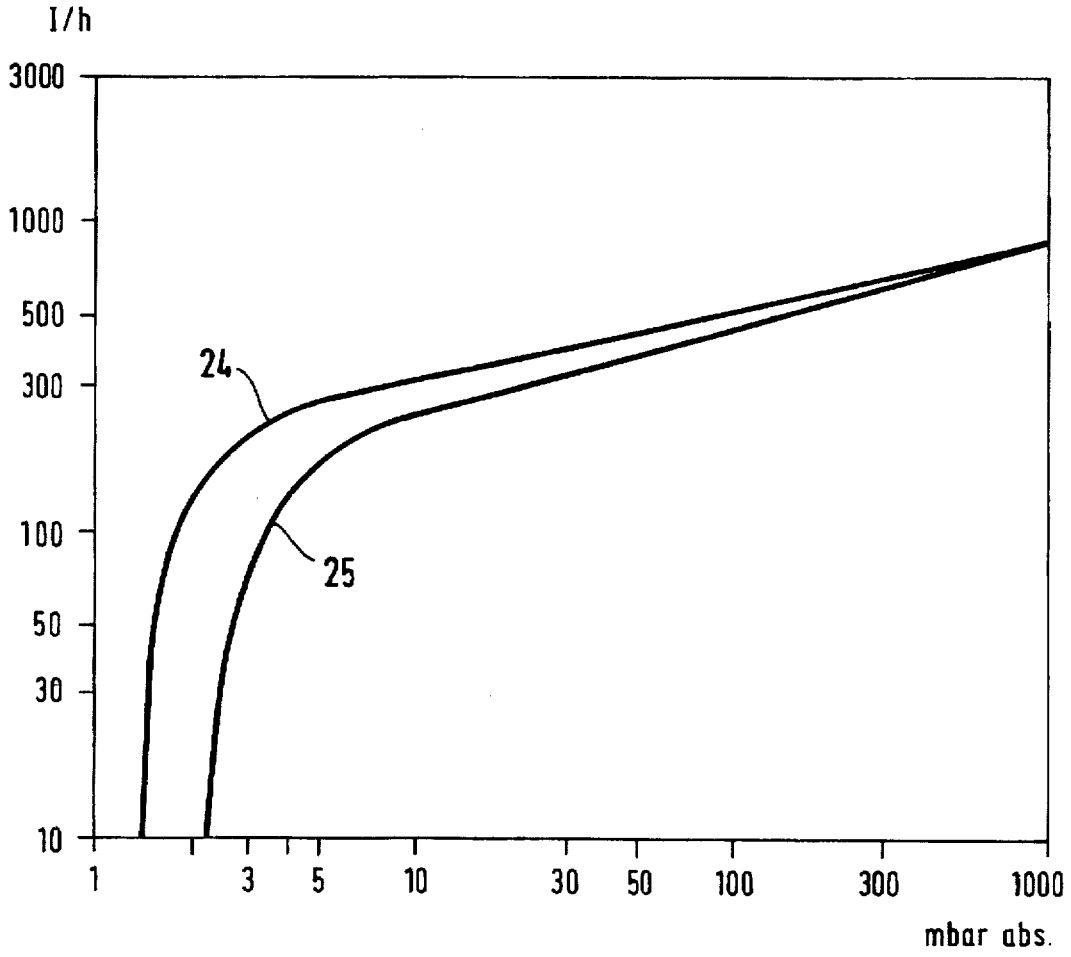

FIG. 5 shows the exhaustion rate curve 24 of the diaphragm pump 2 embodying the invention, compared with the exhaustion rate curve 25 of the diaphragm pump known from German Patent Specification No. 40 07 932 C2, the latter having radial ribs 18 but no stabilizing ribs 19 oriented in the circumferential direction. The exhaustion rate is plotted in liters per hour as a function of the intake pressure of the diaphragm pump 1 indicated in millibars absolute.

FIG. 5 shows that the diaphragm pump 1 provided with radial ribs and stabilizing ribs displays a distinctly improved exhaustion rate, especially at intake pressures below 10 mbar absolute, compared to the diaphragm pump having only radial ribs 18. In addition, the minimum underpressure against which the diaphragm pump 1 is still capable of performing is reduced by about a third compared to the known diaphragm pump. The diaphragm pump 1 embodying the invention is therefore even more suited as a vacuum pump and can also be used particularly as a forepump for a turbomolecular pump.

Mention should also be made that the stabilizing ribs 19 combined with the radial ribs 18 also reduce oscillations in the shaped diaphragm 2 that are liable to lead to the shaped diaphragm 2 impinging on the adjacent wall 14 of the pumping chamber. This means on the one hand that the diaphragm has a longer service life, which is especially advantageous for relatively expensive shaped diaphragms having a Teflon coating. On the other hand, it is also largely avoided that the operation of the inlet and outlet valves be impaired by particles abraded from the shaped diaphragm 2 upon impingement on the wall 14 of the pumping chamber.

To enable the operating forces acting upon the shaped diaphragm 2 to be supported as evenly as possible, altogether four concentric, equispaced stabilizing ribs 19 are arranged on the underside 17 of the annular zone 5. The stabilizing ribs 19 are circumferentially complete on the underside 17 of the diaphragm and cross the radial ribs 18. By this means, the diaphragm forces can be transferred especially well from the stabilizing ribs 19 to the radial ribs 18. Since each radial rib 18 supports a plurality of stabilizing ribs 19, the bending moment of the radial ribs 18 about a circumferential line of the shaped diaphragm 2 is in each case greater than that of the individual stabilizing ribs 19 about a diametral line of the shaped diaphragm 2. For that purpose the radial ribs 18 have a greater height a than the height b of the three outer stabilizing ribs 19.

To graduate the transition to the central zone 3 thicker than the annular zone 5, the inner stabilizing rib 19 has a greater height c than the height b of the outer stabilizing ribs 19. By this means, the elastic material of the diaphragm is loaded more uniformly in the transitional region between annular zone and central zone during the movement of stroke of the shaped diaphragm 2. Additional graduations may be provided for the height of the individual stabilizing ribs 19, this height decreasing as the distance from the central zone 3 increases. The height c of the inner stabilizing ribs 19 is preferably selected to be somewhat smaller than the thickness d of the central zone 3 at the outer edge thereof adjacent to those stabilizing ribs 19.

In order that the stresses at the outer edge of the central zone 3 can be distributed over a sufficiently large cross section of material, despite the comparatively small diameter of the diaphragm at that location, a shoulder 20 forming the transition to the annular zone 5 is provided at the outer edge of the central zone 3. The thickness d of this shoulder 20 corresponds approximately to four times the height b of the outer stabilizing ribs 19. The thickness of the annular zone at the highest point of the inner stabilizing rib 19 is somewhat smaller than the thickness d of the shoulder 20. The radial ribs 18 merge directly into the shoulder 20 at their inner end facing the longitudinal central axis 21 of the shaped diaphragm 2 and with their outer end area they extend right into the thickened clamping edge 6.

To enable the operating forces acting on the annular zone 5 to be conducted even better into the central zone 3, the radial ribs 18 are sloped at their underside between the inner stabilizing rib 19 and the shoulder 20, so that the height of the radial ribs decreases radially outwardly in this area. However the radial ribs 18 have a constant height between the inner stabilizing rib 19 and the clamping edge 6.

Figure 4:
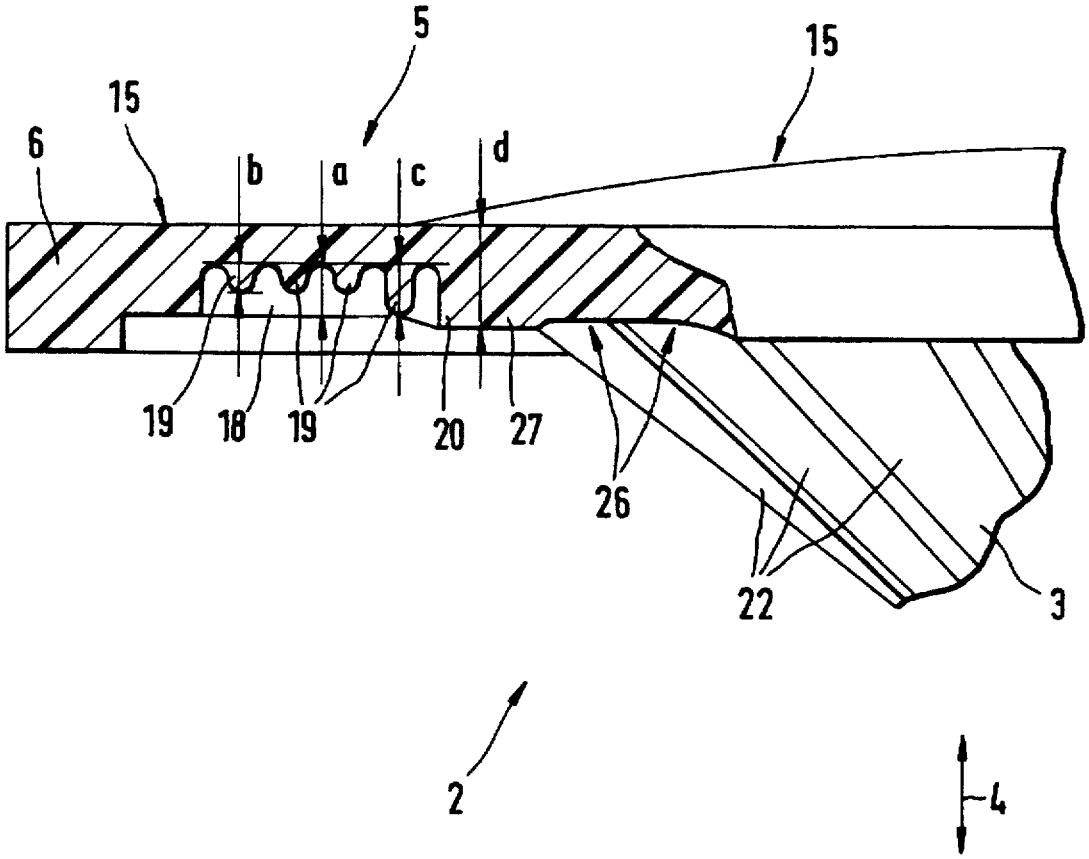
FIG. 4 is an enlargement of the diaphragm detail marked X in FIG. 3, showing especially well the different heights of the individual stabilizing ribs and in the central zone the shoulder forming the transition to the annular zone and FIG. 5 the exhaustion rate of the diaphragm pump embodying the invention as a function of the suction pressure, whereby for comparative purposes the diagram also shows the exhaustion rate curve of the diaphragm pump known from DE-40 932 C2.

As may be seen especially well from FIG. 4, the staggered stabilizing ribs 19 have a substantially undulatory profile in the radial direction, with rounded transitions. By this means the flux of force in the shaped diaphragm 2 is to be distributed especially evenly over the available cross section of material. By comparison, a rectangular cross section is provided for the radial ribs 18 as they are subject to bending practically only in the longitudinal direction.

To permit a central zone 3 of the minimum weight and material, the underside of the central zone 3 is provided with stabilizing projections 22 arranged radially-axially. The stabilizing projections 22 extend from the flange 23 for the connecting rod 11 up to the shoulder 20 and continue outwardly in the radial ribs 18 (FIG. 1). On the one hand the inherent stability of the central zone 3 is thereby increased and on the other hand the supporting forces received by the radial ribs 18 can be transferred even better to the central zone. The shoulder 20 is adjoined radially inwardly by an annular intermediate diaphragm area 27 which is arranged concentrically with respect to the longitudinal axis 21 of the diaphragm and is of substantially constant thickness both in the circumferential direction and along its radial expanse. The radial width of this intermediate area 27 corresponds approximately to its thickness. The intermediate area 27 is adjoined radially inwardly by recesses 26 arranged between the stabilizing projections 22. In the region of these recesses 26 the shaped diaphragm 2—as considered in the direction of the longitudinal central axis 21—is about 10% less thick than in the intermediate area 27.

I claim:

1. A diaphragm pump (1) comprising a shaped diaphragm (2) of elastic material located in a pump case having a pumping chamber with a wall adjacent to the shaped diaphragm (2), the shaped diaphragm (2) including a central zone (3) which is thickened in a direction of stroke (4) of the diaphragm pump (1), a flexible annular zone (5) surrounding the central zone (3), an external clamping edge (6) connected to the flexible annular zone (5), the external clamping edge (6) being attached to the pump case, an upper surface (15) of the shaped diaphragm facing the adjacent wall, and an underside (17) of the shaped diaphragm facing away from the pumping chamber, a connecting rod (11) acting on the central zone of the shaped diaphragm (2) to displace the diaphragm from a top dead-center position to a bottom dead-center position and vice versa, wherein the central zone (3) of the upper surface (15) of the diaphragm facing the pumping chamber (16) and the adjacent wall (14) of the pumping chamber are geometrically adapted to each other, and at least the annular zone (5) of the underside (17) of the diaphragm facing away from the pumping chamber (16) is provided with radial ribs (18) for stabilization, and at least one stabilizing rib (19) running substantially in a circumferential direction is arranged at the underside (17) of the annular zone (5) between adjacent radial ribs (18).

2. The device as claimed in claim 1, wherein a plurality of radially staggered stabilizing ribs (19) are arranged between the adjacent radial ribs (18).

3. The device as claimed in claim 1, wherein the radial ribs (18) have a bending moment about a circumferential line of the shaped diaphragm (2), and the bending moment of the radial ribs (18) is in each case greater than that of an individual stabilizing rib (19) about a radius crossing the radial ribs.

4. The device as claimed in claim 2, wherein the shaped diaphragm has a longitudinal axis and the radial ribs are of a height (a) oriented in a direction of the longitudinal axis (21) of the diaphragm that is greater than a height (b) of at least one of the stabilizing ribs (19).

5. The device as claimed in claim 1, wherein the at least one stabilizing rib (19) is circumferentially complete on the underside (17) of the diaphragm and crosses the radial ribs (18).

6. The device as claimed in claim 1, wherein a plurality of stabilizing ribs (19) are located in the annular zone (5) and the shaped diaphragm has a longitudinal axis, and at least one radially inner stabilizing rib (19) is of greater height (c) in a direction of the longitudinal axis of the shaped diaphragm (2) than at least one stabilizing rib (19) arranged further outwardly.

7. The device as claimed in claim 1, wherein a plurality of stabilizing ribs (19) are located in the annular zone, the radial ribs (18) and the stabilizing ribs have undersides, and the underside of a radially inner stabilizing rib (19) adjoins the underside of the radial ribs (18) so as to be substantially flush therewith.

8. The device as claimed in claim 1, wherein the at least one stabilizing rib (19) includes an inner stabilizing rib (19) having a thickness (c) oriented in a direction of a longitudinal axis of the shaped diaphragm (2), the inner stabilizing rib thickness (c) being substantially equal to or somewhat less than a thickness (d) of the central zone (3) at an outer edge area thereof adjacent to the inner stabilizing rib (19).

9. The device as claimed in claim 2, wherein the radial ribs (18) have an underside and the underside of the central zone of the shaped diaphragm includes a shoulder (20) adjacent to the flexible annular zone, the underside of the radial ribs adjoining the shoulder (20) so as to be flush therewith and the radial ribs (18) having a height which decreases radially outwardly at least between the shoulder (20) and a radially inner stabilizing rib (19).

10. The device as claimed in claim 2, wherein the radial ribs (18) have an underside and the underside of the central zone of the shaped diaphragm includes a shoulder (20) adjacent to the flexible annular zone, the underside of the radial ribs (18) adjoining the shoulder (20) and the radial ribs (18) having a height which decreases radially outwardly at least between the shoulder (20) and a radially inner stabilizing rib (19).

11. The device as claimed in claim 2, wherein the stabilizing ribs (19) are equidistantly radially staggered to form a substantially undulatory profile in a radial direction, and rounded transitions are located between the individual stabilizing ribs (19).

12. The device as claimed in claim 1, wherein the underside (17) of the central zone (3) is downwardly contracted and has an approximately frusto-conical shape, and the underside (17) of the central zone (3) includes stabilizing projections (22) arranged substantially radially-axially and the stabilizing projections (22) continue outwardly in alignment with the stabilizing ribs (18) of the annular zone (5).

13. The device as claimed in claim 12, wherein at least one of the stabilizing ribs (19)and the stabilizing projections (22) have an approximately rectangular cross section in a circumferential direction of the shaped diaphragm (2).

14. The device as claimed in claim 1, wherein the radial ribs (18) are evenly distributed around a circumference of the shaped diaphragm (2) so as to be spaced at intervals of about 20° and in each case four radially staggered stabilizing ribs (19) are provided between adjacent radial ribs (18).

* * * * *